US006279287B1

(12) United States Patent
Meadows

(10) Patent No.: US 6,279,287 B1
(45) Date of Patent: Aug. 28, 2001

(54) PREFABRICATED BUILDING PANEL AND METHOD OF MANUFACTURING SAME

(75) Inventor: James A. Meadows, Hermitage, TN (US)

(73) Assignee: Shoshone Station LLC, Rockford, MI (US)

( * ) Notice: Subject to any disclaimer, the term of this patent is extended or adjusted under 35 U.S.C. 154(b) by 0 days.

(21) Appl. No.: 09/370,286

(22) Filed: Aug. 9, 1999

Related U.S. Application Data

(60) Provisional application No. 60/096,298, filed on Aug. 12, 1998.

(51) Int. Cl.[7] ..... E04B 2/08; E04C 1/00

(52) U.S. Cl. ..... 52/589.1; 52/309.9

(58) Field of Search ..... 52/309.1, 529.1, 52/582.1, 589.1, 309.9, 592.1

(56) References Cited

U.S. PATENT DOCUMENTS

| | | | | |
|---|---|---|---|---|
| 2,447,272 | | 8/1948 | Parkes . | |
| 2,739,677 | | 3/1956 | Greulich . | |
| 2,891,638 | | 6/1959 | Grundy et al. . | |
| 3,016,316 | * | 1/1962 | Olson | 52/592.1 |
| 3,469,873 | | 9/1969 | Glaros . | |
| 3,535,844 | | 10/1970 | Glaros . | |
| 3,760,548 | * | 9/1973 | Sauer et al. | 52/592.1 |
| 4,100,710 | | 7/1978 | Kowallik . | |
| 4,143,498 | | 3/1979 | Martin, Jr. et al. . | |
| 4,177,615 | | 12/1979 | Anderson . | |
| 4,283,897 | | 8/1981 | Thompson . | |
| 4,304,083 | * | 12/1981 | Anderson | 52/309.9 X |
| 4,316,351 | | 2/1982 | Ting . | |
| 4,379,480 | | 4/1983 | Kempel et al. . | |
| 4,435,934 | | 3/1984 | Kim . | |
| 4,546,590 | | 10/1985 | Finch et al. . | |
| 4,575,981 | | 3/1986 | Porter . | |
| 4,743,485 | | 5/1988 | Ting . | |
| 4,790,112 | | 12/1988 | Wang . | |
| 4,936,069 | | 6/1990 | Hunter et al. . | |
| 4,936,078 | | 6/1990 | Porter . | |
| 5,181,353 | | 1/1993 | Harrington, Jr. . | |
| 5,228,257 | | 7/1993 | Bowersox et al. . | |
| 5,293,728 | | 3/1994 | Christopher et al. . | |
| 5,373,678 | | 12/1994 | Hesser . | |
| 5,425,210 | * | 6/1995 | Zafir | 52/592.1 X |
| 5,448,865 | | 9/1995 | Palmersten . | |
| 5,509,242 | | 4/1996 | Rechsteiner et al. . | |

* cited by examiner

*Primary Examiner*—Daniel P. Stodola
*Assistant Examiner*—Hugh B. Thompson
(74) *Attorney, Agent, or Firm*—King and Schickli PLLC

(57) ABSTRACT

A prefabricated building panel includes first and second side panel members. A thermally insulating core is disposed between those side panel members. A first panel end surface includes a pair of spaced projections defining a channel-way. A second panel end surface includes a pair of spaced channels and a thermal barrier plug. Two adjacent building panels may be interconnected by engaging the pair of spaced projections at the first end of the first panel in the pair of spaced channels in the second end of the second panel while simultaneously engaging the thermally insulating plug at the second end of the second panel in the channel-way at the first end of the first panel.

18 Claims, 4 Drawing Sheets

PREFABRICATED BUILDING PANEL AND METHOD OF MANUFACTURING SAME

This application claims the benefit of U.S. Provisional Application Ser. No. 60/096,298, filed Aug. 12, 1998.

TECHNICAL FIELD

The present invention is directed to a prefabricated building panel which is adapted for assembly as a modular unit into a structural wall or the like, and more particularly, an insulating building panel having edge constructions which provide enhanced wall integrity and simplified panel manufacture.

BACKGROUND OF THE INVENTION

The use of prefabricated insulating building and wall panels having metal front or back side surfaces or skins in building construction is well known. U.S. Pat. No. 5,181,353 to Herrington, Jr. discloses the assembly of conventional prefabricated building panels having a thermally insulating foam core sandwiched between two side sheet panels into a building structure. To assemble the building structure, tongued edge connectors are fitted into grooved panel edges which are devoid of the foam core, to join the edges of adjacent panels. A difficulty with the building panels shown in Herrington, Jr. exists, however, in that when the panel sides are formed from metal, no thermal break exists between the outer panel side, the connector and the inner panel side. The Herrington, Jr. panel system is therefore poorly suited for use in residential or commercial building applications as it permits heat loss by thermal conduction through the panel sides and connector.

One attempt to provide a structural panel which when assembled, provides a thermal break between the inner and outer panel side surfaces is disclosed in U.S. Pat. No. 5,373,678 to Hesser. Hesser teaches a panel having a foam core and metal side skins. Each panel edge includes a forwardly projecting metal tongue which is offset from the panel center towards one panel side, and a recessed metal groove spaced towards the opposing side. The groove is formed so as to be adapted to receive the forwardly projecting tongue of an abutting panel positioned edge to edge therewith. To provide a thermal break between the outer and inner sides of the panel, the tongue and groove of each edge are spaced from each other by an exposed angularly extending face of the foam core. The edge portion of the Hesser panel further includes a separate reinforcing member which is bent around the groove to provide the panel edge with enhanced rigidity. Assembly of a wall is achieved by positioning the panels in an edge-to-edge configuration and driving two separate rows of screws through each mated panel edge, wherein each row of screws is offset from the other.

The panel of Hesser suffers a disadvantage in that the addition of the reinforcing member to the panel construction complicates the panel manufacture, and increases the overall cost of the panel. As well, to manufacture the Hesser panel, the insulating foam core must be injected between the panels, and following curing, cut to the exposed angular face extending precisely from an innermost end of the tongue to an outermost edge of the edge groove. In cutting the injected foam along each edge of the panel, it is necessary that the foam face be formed at the exact angle so as not to interfere with the interlocking of the panel tongues into the grooves of the adjacent panel, when two panels are placed edge to edge. The process step of cutting the core after the foam injection between the panel sides further results in manufacturing inefficiencies, increasing the finished panel costs.

Because the tongue and groove of the Hesser panels are laterally offset from each other, to assemble each edge of the panels securely, it is essential that rows of screws be driven through the panels at least two laterally staggered locations. This increases both the cost and time involved in the panel erection. As well, because the screws used to secure each side portion of adjacent panels together may be laterally staggered along opposite sides of the panels, rotational forces on the panels may cause the panels to twist relative to each other between the rows of fasteners. The twisting in turn may disadvantageously result in the shearing of the tongues, or the delamination of the metal panel sides or skins from the insulating core.

SUMMARY OF THE INVENTION

Accordingly, it is an object of the present invention to provide a building system which includes a number of modular prefabricated building panels which may be coupled together to form a building wall, roof, foundation or other building structure, and wherein the edges of two adjacent panels are secured together by screws, nails, clips or other fasteners along a single longitudinal portion of the panels.

Another object of the invention is to provide an improved prefabricated building panel having a thermally insulating core, metal inner and outer sides, and an edge configuration which permits simplified manufacture of the building panel.

Another object of the invention is to provide a modular building panel which is adapted for assembly with other like panels to form a wall, roof, foundation or other building structure by positioning two or more panels in abutting edge-to-edge relationship.

A further object of the invention is to provide a prefabricated building panel having an insulating foam core sandwiched between spaced apart inner and outer planar metal sides, whereby the panel is formed having an overall planar configuration and has edge portions which are symmetrical about the mid-plane of the panel.

Another object of the invention is to provide a building panel which includes two opposing edge surfaces, one of which includes a pair of projecting members and the other which includes a pair of complementary sized grooves, whereby the projecting members of one panel edge are adapted for insertion into the grooves formed in an abutting edge portion of an adjacent like panel, and which when secured in an abutting edge-to-edge configuration provide a thermal break between the outer and inner sides of the coupled panels.

A further object of the invention is to provide a building panel having a rigid thermally insulating core which is encased by inner and outer sides or skins, and at least two edge surfaces, wherein the edge surfaces are formed in part by bending metal sheets used to form the sides along longitudinal edges to form a first edge surface having at least two channels separated by a projecting tongue, and a second edge surface having two corresponding projections configured for mated insertion within the channels.

Another object of the invention is to provide a prefabricated building panel characterized by an edge surface having a pair of longitudinally extending square groove-like channels which are spaced from each other by an electrically insulating and/or thermally non-conductive tongue or strip made from rubber, plastic, high density polyethylene or other thermally non-conductive material.

A further object of the invention is to provide a prefabricated building panel having a thermally insulating core sandwiched between a pair of spaced co-planar metal side panels, and wherein each side panel consists of a single planar sheet of metal which is integrally formed with a projection at a first longitudinal edge portion and a complementary shaped groove at another opposing longitudinal edge portion, and wherein the projection and groove each have a double wall construction.

Another object of the invention is to provide a structural wall assembly which includes a plurality of prefabricated building panels coupled in an edge-to-edge relationship, wherein the edge surfaces of each panel are connected with an abutting edge surface of adjacent panels by inserting fasteners through interlocking portions of the panels.

A further object of the invention is to provide an improved method for manufacturing a prefabricated building panel having metal inner and outer sides and a thermally insulating rigid core consisting of a closed cell foamed polystyrene, urethane and/or polyethylene.

To achieve at least some of the foregoing objects, the present invention provides a prefabricated building panel which may be assembled as a module to other like panels in an abutting edge-to-edge configuration to form a structural wall, building roof, foundation or the like. In a simplified construction, the building panel has a generally rectangular shape having two parallel longitudinally extending edge surfaces. Where more complex structures are to be formed, such as roofs and the like, the building panel could, however, be formed with overall pie or other polygonal shapes. Each longitudinal edge surface of one building panel is coupled in abutting juxtaposition with a longitudinal edge surface of an adjacent panel.

For ease of transport and assembly, the prefabricated building panels have a lateral width of between about 1 and 4 feet, and preferably about 2 feet. The building panels may be formed having almost any longitudinal length. Preferably, the panels are provided in 8 to 10 foot lengths when used for residential building wall constructions, however, lengths of up to 60 feet or more are possible where the building panels are to be used in the construction of commercial buildings, roofs and the like.

Each panel includes a rigid thermally insulating foam core which is sandwiched between inner and outer spaced apart and substantially coplanar side panel members. The core has a thickness selected to provide the building panel with the desired thermal insulating property. The rigid core could be formed from a number of thermally insulating materials, including foamed polystyrene, foamed polyethylene or a foamed closed cell urethane to name but a few. Depending on the type of core material used and the insulating property to be achieved, the building panel has an overall thickness greater than 1.5 inches, preferably between about 2.5 and 10 inches and most preferably is between about 3 to 4.5 inches thick.

The side panel members are each formed from a single or multiple joined sheets of metal, plastic or other polymers. Preferred materials used to form the side panel member include galvanized steel or aluminum sheets having a thickness selected between about 18 and 30 gauge. Although not essential, the exposed exterior surface of one or both of the side panel members may be textured with pebbling, ribs, grooves, or the like to facilitate the adhesion of a covering layer of paint, mortar, stucco or plaster directly to the exposed side panel surfaces. Similarly, the hidden interior surface of one or both of the side panel members may be textured with pebbling, ribs, grooves, or the like to facilitate the adhesion of the insulating core directly thereto and prevent delamination of the side panel members from the foam core.

The longitudinal edge surfaces of the building panel span the thickness of the building panel between aligned edges of the inner and outer side panel members. The longitudinal edge surfaces are symmetrical about a mid-plane of the building panel which extends half-way between and co-planar with the planar side panel members.

A first longitudinal edge surface is provided with a pair of spaced apart projections or tongues which extend the longitudinal length of the building panel. The spacing of the projections from each other defines a longitudinally extending slot or channel-way therebetween which is centered on the panel mid-plane. The projections have the identical configuration and are each recessed from a proximate side panel member towards the panel mid-plane by an associated shoulder which extends from a longitudinal edge of the proximate side member thereto.

The second longitudinal edge surface which is opposite the first is formed for complementary mated engagement with the first edge surface. The second edge surface is provided with a pair of grooves or channels extending the longitudinal length of the panel. The channels have a size and spacing selected to permit the insertion of the projections on the first edge surface of an adjacent building panel therein, in a complementary fit. The channels are separated from each other by a longitudinally extending tongue which is sized for fitted insertion within the channel-way in the first edge surface of the adjacent panel. Like the projections, each channel is recessed from a proximate side member by an associated end face. The end faces extend from the longitudinal edge of each of the inner and outer side panel members to its associated adjacent channel. Each end face is sized so that when the first and second edge surfaces are moved into abutting alignment with the projections located within the channels and tongue located in the channel-way, the end faces of the second edge surface each abuttingly engage one of the shoulders of the first edge surface and the side panel members of the aligned, adjacent building panels.

The pairs of associated shoulders and projections, and the associated end faces and channels may be formed from one or more separate members which are attached to the panel side member by welding or other mechanical fasteners. More preferably, however, each symmetrical half of the edge surfaces and panel side member is made from a single integral sheet of metal. In this manner, one associated shoulder and projection, and one associated end face and channel are formed by bending opposing edge portions of the sheet used to form the inner side panel member so as to be integrally formed therewith. Similarly, the sheet used to form the outer side panel member is bent in a like manner to form the other associated shoulder and projection and associated end member and channel integrally therewith. More preferably, each of the shoulders, projections, end faces and channels are formed having a double wall construction for increased structural integrity.

To provide an effective thermal barrier between the inner and outer side panel members, the channel-way preferably is open to the insulating core. The tongue which extends between the channels may comprise a strip of rubber, plastic, polyethylene or other thermally non-conductive material, which is sized to fit snugly within the channel-way to provide a thermal break between the inner and outer sides of the panel.

Accordingly, in one aspect, the present invention resides in a prefabricated building panel comprising, first and second generally planar side members each having first and second longitudinally extending parallel edges, said first side member being spaced from and co-planar with said second side member, a first edge surface spanning between said first edge of said first and second side members substantially along their longitudinal length, said first edge surface including a pair of longitudinally extending spaced apart projecting members and a pair of shoulder members, said projecting members each being symmetrically disposed about a mid-plane of the building panel and defining a longitudinally extending slot therebetween, a first one of said shoulder members joining said first side member and a first one of said projecting members, the second other one of said shoulder members joining said second side member and the second other one of said projecting members, the second edge surface spanning between said second edges of said first and second members substantially along their longitudinal length, said second edge surface configured for mated engagement with a first edge member of an adjacent panel and including, first and second spaced apart channels, each having a complementary size and shape to said first and second projection members, respectively, a tongue separating said first channel from said second channel and being centered on said panel mid-plane, said tongue sized for complementary fitted placement in said slot and extending substantially the longitudinal length of the second edge member, a first end face extending from said first side member to said first channel, said first end face having a complementary size to said first shoulder member, a second end face extending from said second side member to said second channel, said second end face having a complementary size to said second shoulder member, a rigid insulating core material interposed between said first and second side members, wherein when said second edge surface is positioned in mated engagement with a first edge surface of an adjacent panel, said first and second projection members locate in said respective first and second channels with said tongue disposed in said slot and said first end face abutting said first shoulder and said second end face abutting said second shoulder.

In a further aspect, the present invention resides in a prefabricated building panel comprising, first and second generally planar metal side members, each of said first and second side members being elongated in a longitudinal direction and having first and second opposing substantially parallel edges, said first side member being spaced from and co-planar with said second side member, a first edge surface spanning substantially from said first edge of said first side member to said first edge of said second side member, and being substantially symmetrical about a mid-plane of said panel, said first edge surface including an associated first shoulder and first projecting member integrally formed with said first side member, and an associated second shoulder and second projecting member integrally formed with said second side member, said first shoulder joining said first projecting member and said first edge of said first side member, said second shoulder joining said second projecting member and said first edge of said second side member, said first and second projecting members being spaced from each other and defining a longitudinally extending channel-way therebetween centered along said panel mid-plane, a second edge surface spanning substantially from said second edge of said first side member to said second edge of the second side member, and being substantially symmetrical about said mid-plane, said second edge surface configured for abutting placement with the first end of a further adjacent building panel, said second end including, an associated first channel and first end face integrally formed with said first side member, an associated second channel and second end face integrally formed with said second side member, said first channel being spaced from said second channel by a thermal-break, and each of said first and second channels having a complementary size and shape to said respective first and second projecting members, said first end face extending from said first side member to said associated first channel, and said second end face extending from said second side member to said associated second channel, said thermal-break sized for insertion in said channel-way when said first projecting member locates in said first channel and said second projecting member locates in said second channel, rigid insulating core material being disposed intermediate said first and second side members, said insulating core extending into said first and second projecting members of said first edge surface and to said first and second end faces at said second edge surface of said panel.

BRIEF DESCRIPTION OF THE DRAWINGS

Further objects and advantages of the invention will appear from the following description, taken together with the accompanying drawings in which.

DETAILED DESCRIPTION OF THE DRAWINGS

Figure 1:
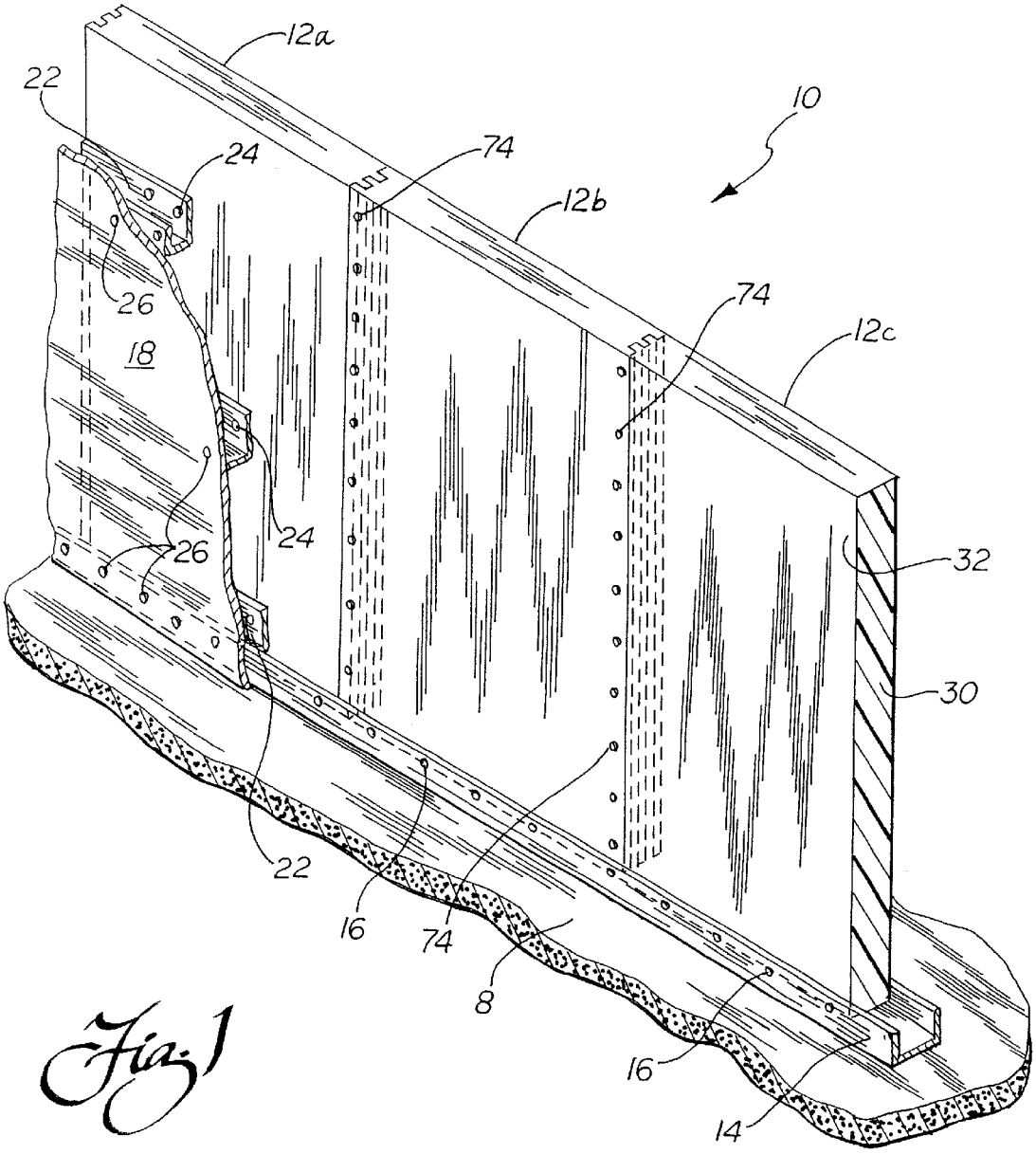
FIG. 1 shows a partially cut-away perspective view of an assembled structural wall in accordance with a preferred embodiment of the invention.
Figure 1A:
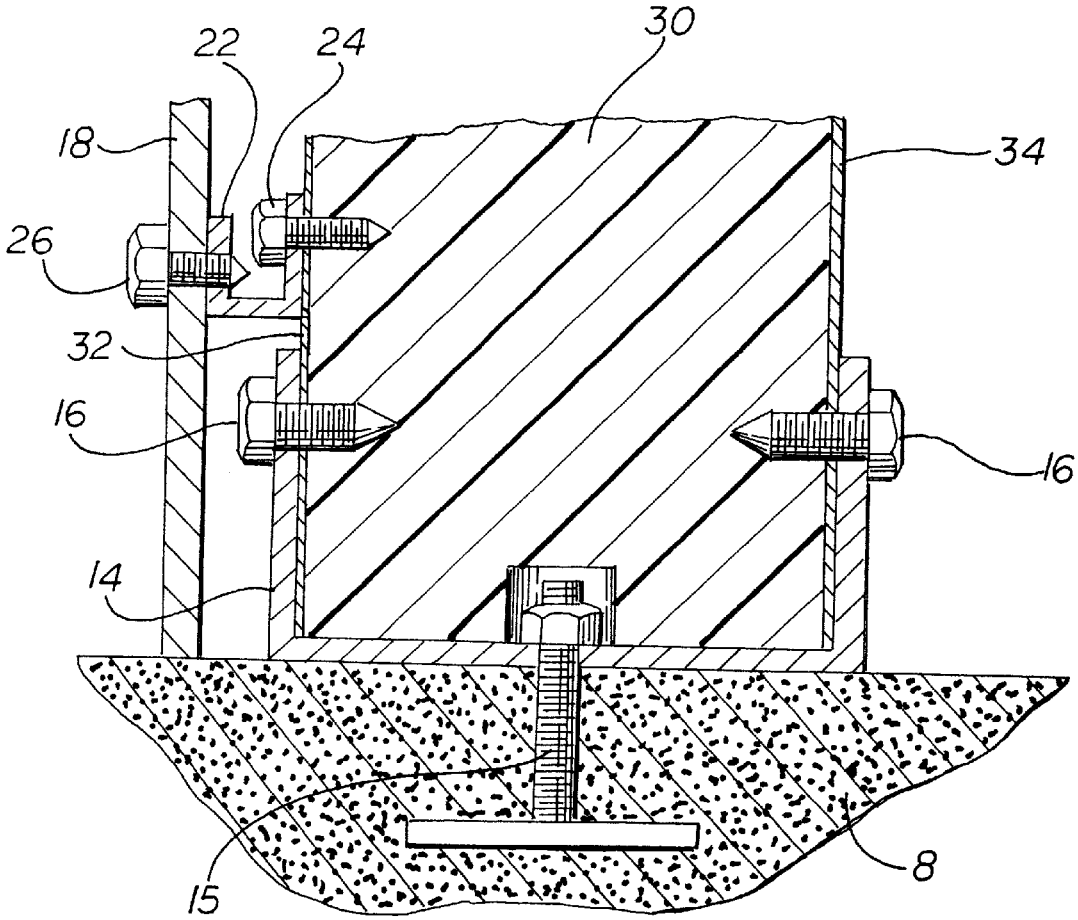
FIG. 1*a* is a detailed cross sectional view showing the mounting of a panel of the present invention to a concrete foundation.

Reference is made to FIG. 1 which shows a structural wall 10 fabricated from a number of modular prefabricated building panels 12*a–c*, in accordance with a preferred embodiment of the invention. As will be described hereafter, the backbone of the wall 10 is formed by connecting a number of the prefabricated building panels (shown 12*a*, 12*b*, 12*c*) in an abutting edge-to-edge configuration on top of a concrete foundation 8. To secure the wall 10 in place, a steel U-shaped track 14 is anchored to foundation 8 in an upwardly open orientation by lag bolts 15 and cooperating nuts (see also FIG. 1*a*). The track 14 has an internal width marginally greater than the thickness of the panels 12*a–c*, so that the bottom edge of the panels 12*a–c* may be inserted into the track 14 in an abutting edge-to-edge position and secured therein by self-tapping screws 16. Of course, the height of the sidewalls of the track 14 may be varied depending upon the amount of support required. For taller track sidewalls, multiple rows of self-tapping screws 16 may be used for interconnection, if desired.

The internal surface of the wall 10 is shown with an optional finished covering of drywall 18. The drywall sheets 18 are secured in place to square U-shaped rails 22. The rails 22 are mounted in a generally horizontal position directly to the panels 12*a–c* at vertically spaced locations by ¾ inch self-tapping screws 24. The drywall sheet 18 is coupled to the rails 22 by drywall screws 26 which are driven through the drywalls sheets 18 and into the interior of the panels 12*a–c* along the length of the rail 22. The use of the rails 22 in mounting the drywall sheets 18 advantageously secures the drywall sheets 18 in position a spaced distance from the panels 12*a–c*, so that an air space 28 exists therebetween. The air space 28 between the drywall sheets 18 and panels 12*a–c* advantageously increases the overall thermal insulation value to the wall 10 by a factor of approximately R-7.

Figure 2:
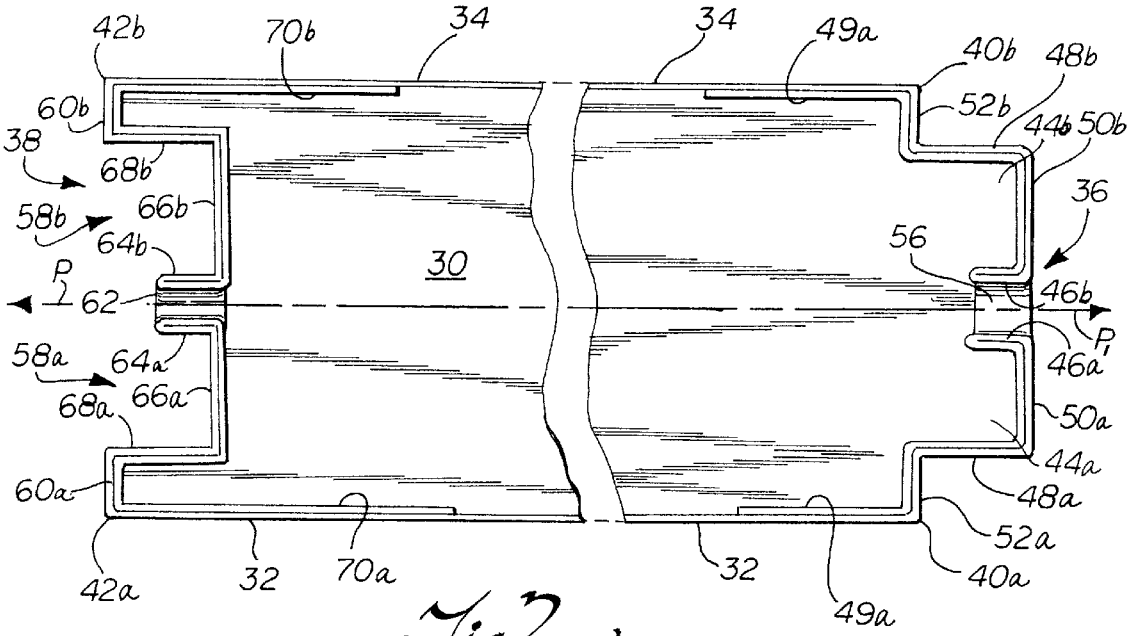
FIG. 2 shows a top plan view of a prefabricated building panel used in the assembly of the structural wall of FIG. 1.
Figure 4:
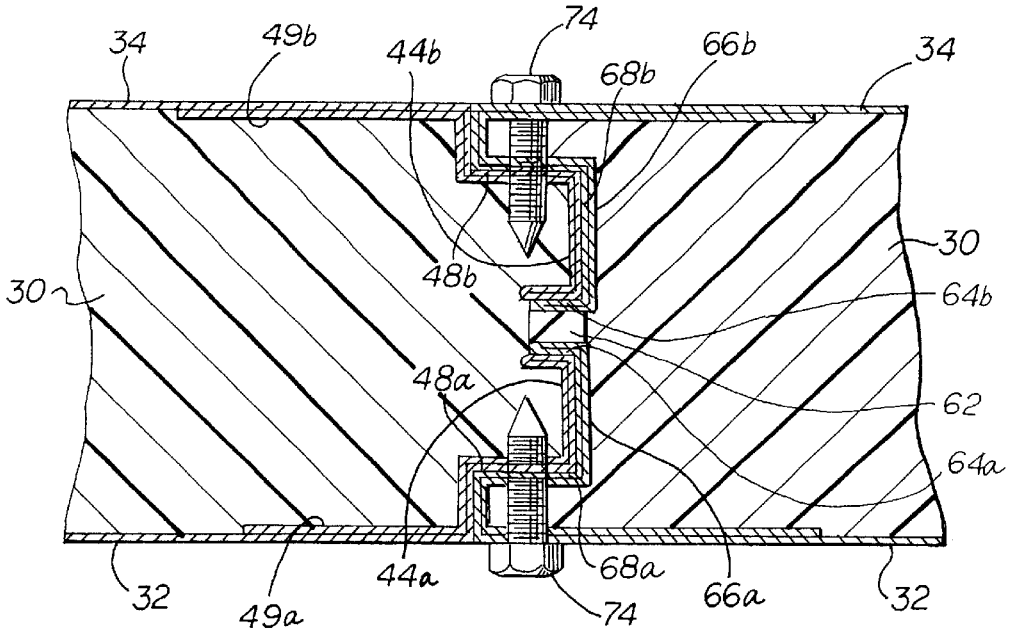
FIG. 4 shows a cross-sectional view of abutting edges of the building panels shown in FIG. 3.
Figure 3:
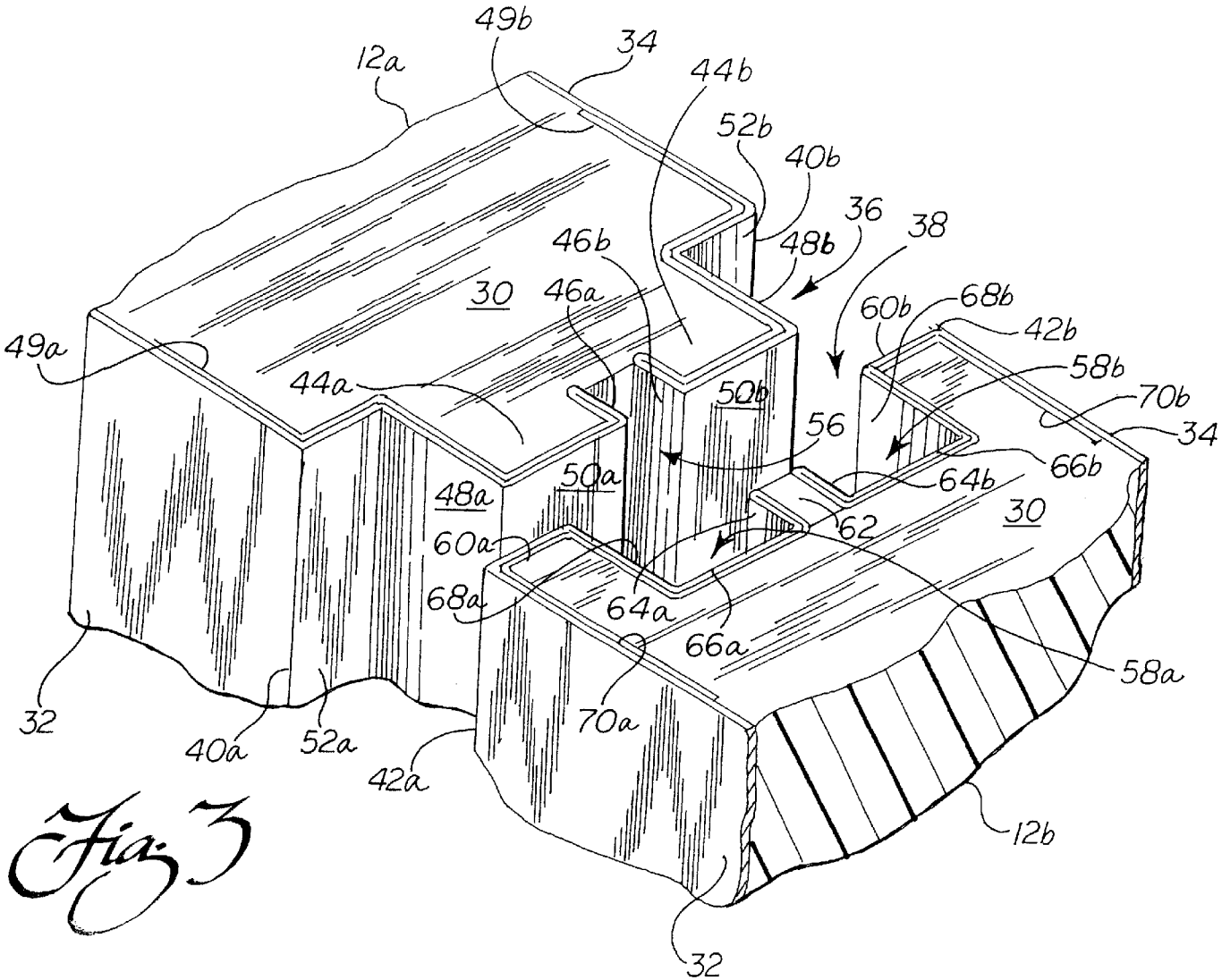
FIG. 3 shows an exploded perspective view of the abutting edge portions of two adjacent building panels used in the assembly of the structural wall of FIG. 1.

In the assembly of the wall 10,each building panel 12 is most preferably provided as part of a prefabricated kit, although custom cutting of the panels 12*a–c* to a desired length may be achieved with a circular saw. FIGS. 2–4 show best the edge construction of each individual prefabricated building panel 12*a–c*, with FIGS. 3 and 4 illustrating the manner in which adjacent panels 12*a*, 12*b*, 12*c* are interconnected to each other. It is to be appreciated that each of the panels 12*a*, 12*b*, 12*c* have the identical construction shown in FIGS. 2–4 which permits the assembly of the wall 10 by securing together a number of adjacent panels 12*a–c* in an abutting edge-to-edge configuration as modular units.

The panels 12*a–c* have a generally rectangular construction with a lateral width of between about 1.5 and 3 feet, and more preferably approximately 2 feet, and a thickness of approximately 3.5 inches. The longitudinal length of the panels 12*a–c* may be selected having regard to the intended use of the wall structure to be assembled, and is provided in either standard 8 foot or 10 foot lengths for residential use.

The building panels 12*a–c* each include a rigid thermally insulating core 30 which is sandwiched between and bonded with inner and outer planar side panel members 32, 34. As will be described, the side panel members 32, 34 have substantially an identical size and shape, each being formed from a rolled sheet of 24 gauge metal such as galvanized steel or aluminum. FIG. 2 best shows the side panels members 32, 34 positioned in a substantially aligned and parallel planar relationship. The side panel members 32, 34 are spaced from and oriented parallel to a panel mid-plane $P–P_1$ located one-half way therebetween. Optionally, both the outward facing and inward facing surfaces of the side panel members 32, 34 may be provided with a textured finish (not shown) such as pebbling or the like to facilitate the adhesion of paint or stucco to the exposed surfaces of the panel members 32, 34,and the adhesion of the rigid core 30 to the inward facing surfaces of the panel members 32, 34 to prevent panel delamination.

Each building panel 12*a–c* is formed having a construction which is symmetrical about the panel mid-plane $P–P_1$. Each panel 12*a–c* includes parallel opposing panel end or edge surfaces 36, 38 which extend the longitudinal length of the panel 12*a–c* . The panel edge surface 36 spans between a first longitudinal edge 40*a* of the inner side panel member 32 and an aligned first longitudinal edge 40*b* of the outer side panel member 34. The edge surface 38 similarly spans between the second outer longitudinal edge 42*a* of the inner side panel member 32 and an aligned second longitudinal edge 42*b* of the outer side panel member 34.

The edge surface 36 includes a pair of generally rectangular projections 44*a*, 44*b* each characterized by parallel inward and outward sides 46*a*, 48*a*, 46*b*, 48*b*, joined by a flattened end 50*a*, 50*b*. The projections 44*a*, 44*b* are each joined to a respective edge 40*a*, 40*b* by associated shoulders 52*a*, 52*b* which are each integrally formed with both a respective side panel member 34, 36 and the projections 44*a*, 44*b*. FIG. 2 shows best the shoulder 52*a* extending perpendicularly from the first edge 40*b* of the side member 32 to the outward side 48*a* of the projection 44*a*. The shoulder 52*a* extends inwardly from the member 32 towards the panel mid-plane $P–P_1$ a distance of between about ¼ and ¾ inches, and more preferably approximately 0.5 inches. Shoulder 52*b* joins edge 40*b* and the outward side 48b of projection 44*b* in an identical manner. The outward sides 48*a*, 48*b* of the projections 44*a*, 44*b* are provided in a substantially co-planar relationship with side members 32, 34 and extend approximately ¾ inches to the ends 50*a*, 50*b* of the respective projections 44*a*, 44*b*. The ends 50*a*, 50*b* are positioned normal to side panel members 32, 34 and extend towards the mid-plane $P–P_1$ to a respective inward side 46*a*, 46*b*. The side 46*a*, 46*b* of each projection 44*a*, 44*b* is bent perpendicularly towards the other panel edge surface 38, as an inwardly extending flange. Each inward side 46*a*, 46*b* extends into the interior of the panel 12*a–c* and towards the edge surface 38 a preferred distance of at least ¼ inch.

The spacing of the projection 44*a* from projection 44*b* on each side of the mid-plane $P–P_1$ defines a longitudinally extending channel slot or way 56 therebetween. The sides of the channel-way 56 are bordered by the inward sides 46*a*, 46*b* of the projections 44*a*, 44*b*, with the channel-way 56 being open to the insulating core 30 in the interior of the panel 12*a–c*. The channel-way 56 extends the length of the panel end 36 centered with the mid-plane $P–P_1$ and has a preferred width of about ¼ inch. The open channel-way 56 thus provides a thermal break across the edge surface 36 between the metal side panel member 32 and side panel member 34.

The construction of the panel edge surface 36 is shown whereby the shoulder 52*a* and the projection 44*a* are integrally formed from the same single sheet of metal used to form the side panel member 32, thereby providing the panel edge surface 36 with increased structural integrity. It is to be appreciated that shoulder 52*b* and projection 44*b* are also formed in a like manner and with the mirror construction of projection 44*a* and shoulder 52*a*, from the same single sheet of metal used to form side panel member 34. Although not essential, shoulders 52*a*, 52*b* and projections 44*a*, 44*b* are preferably provided with a double wall construction. Optionally, for added structural integrity, the metal sheets used to form the side panel members 32, 34 may be bent to additionally include overlapping reinforcing flanges 49*a*, 49*b* which are positioned in an abutting relationship with respective side panel members 32, 34 and each of which is secured to an inward surface of the side panel members 32, 34 by welding or the like.

The edge surface 38 is formed having a complementary profile to edge surface 36 so as to permit the interlock of aligned edge surfaces 36, 38 of adjacent panels 12*a–c* in the abutting edge-to-edge configuration shown in FIG. 4. Like edge surface 36,edge surface 38 is symmetrical about the panel mid-plane $P–P_1$. The edge surface 38 includes a pair of rectangular longitudinally extending grooves or channels 58*a*, 58*b* spaced inwardly from a respective peripheral edge 42*a*, 42*b* of each side panel member 32, 34 by an associated end face 60*a*, 60*b*. End face 60*a* extends perpendicularly from the longitudinal edge 42*a* of side member 32 to the channel 58*a* and has a complementary size to that of shoulder 52*a*. Similarly, end face 60*b* extends perpendicularly from the edge 42*b* of the side member 34 to the channel 58*b*, and has a complementary size to that of shoulder 52*b*. The grooves 58*a*, 58*b* are separated from each other by an elongated tongue or strip of high density polyurethane 62 which is aligned with the mid-plane $P–P_1$ ofthe panel 12*a–c*.

Each of the channels 58*a*, 58*b* has a generally square U-shape and is configured to receive a corresponding projection 44*a*, 44*b* therein. The channels 58*a*, 58*b* include, respectively, an innermost channel wall 64*a*, 64*b* spaced closest towards the mid-plane $P–P_1$, a substantially flat channel end wall 66*a*, 66*b* and an outward channel wall 68*a*, 68*b*. The walls 64*a*, 68*a*, 64*b*, 68*b* of each channel 58*a*, 58*b* extend substantially parallel to each other and the side panel member 32, 34,and substantially perpendicular to the channel end wall 66*a*, 66*b*.

The side panel member 32, end face 60*a* and channel 58*a* are formed from the same single sheet of metal used to form the projections 44*a* and shoulder 52*a* of the opposing edge surface 36. As with the projections 44*a* and shoulders 52*a*, the end face 60*a* and channel 58*a* are formed with a double wall construction by bending an edge portion of the sheet metal back over itself. The panel 12 further includes a reinforcing flange 70*a* secured in overlapping configuration with the edge portion of the side 32 by welding or the like. The metal sheet used to form the side panel member 34 is bent along its edge 42*b* in an identical manner so as to define the channel 58*b*, end face 60*b*, and a reinforcing flange 70*b*, each with the mirror construction to channel 58*a*, end face 60*a*, and reinforcing flange 70*a*.

The innermost channel walls 64*a*, 64*b* of the channels 58*a*, 58*b* are each spaced apart from each other and the mid-plane $P–P_1$, of the panel 12. The polyurethane strip 62 is sized for insertion between the walls 64*a*, 64*b* of the channels 58*a*, 58*b* aligned with the panel mid-plane $P–P_1$. In this position, the strip 62 functions as a thermal barrier across the edge surface 38. The innermost walls 64*a*, 64*b* of the channels 58*a*, 58*b* are separated by a distance selected to permit their complimentary insertion together with the strip 62 as an elongated tongue or plug into the channel-way 56 of an abutting panel, when the edge surface 38 of one panel 12*b* is moved into an abutting relationship with the edge surface 36 of an adjacent panel 12*a* in the manner shown in FIG. 4.

It is to be appreciated that the channels 58*a*, 58*b* are provided with an overall configuration which is selected so that when the projections 44*a*, 44*b* are moved fully therein, the ends 50*a*, 50*b* of the projections 44*a*, 44*b* are placed in abutting juxtaposition with a respective channel end wall 66*a*, 66*b*, the end faces 60*a*, 60*b* are positioned in abutting juxtaposition with shoulders 52*a*, 52*b* respectively, the strip 62 and sides 64*a*, 64*b* locate in the channel-way 56, and the outer sides 48*a*, 48*b* of projections 44*a*, 44*b* are positioned in an overlapping position with outward walls 68*a*, 68*b* of the channels 58*a*, 58*b*, respectively.

The thermally insulating core 30 is made of a closed cell urethane, polyethylene or polystyrene which is sandwiched between the side panel members 32, 34. Most preferably, with the exception of the channel-way 56, the core 30 completely infills the interior of the panel 12. In the manufacture of the panel 12, the insulating core material 30 is injected between the panel side members 32, 34 in a semi-liquid form so as to almost completely fill the spacing between the side members 32, 34. The core 30 extends into the associated projections 44*a*, 44*b* and shoulders 52*a*, 52*b*, and to the end faces 60*a*, 60*b* and channels 58*a*, 58*b*. In this manner, when the insulating core 30 has set, it maintains the structural integrity of the panel 12 and prevents delamination of the metal side panel members 32, 34. More particularly, once the insulating core 30 sets, it forms a solid rigid core material. As shown best in FIG. 2, the movement of the insulating core 30 to the ends 50*a*, 50*b* of the projections 42*a*, 42*b* ensures that the innermost sides 46*a*, 46*b* of projection 44*a*, 44*b* prevent the metal from delaminating from the core at the panel edge surface 36. Similarly, the movement of the insulating core 30 to the end faces 60*a*, 60*b* ensures that the outward walls 68*a*, 68*b* of the channels 58*a*, 58*b* prevent the delamination of the panel edge surface 38.

FIGS. 3 and 4 show best the interlock of the abutting edge surfaces 36, 38 of two adjacent panels 12*a* and 12*b*. It is to be appreciated that panel 12*a* has an opposite panel edge surface (not shown) having a configuration which is identical to the edge surface 38 of panel 12*b*, so as to permit mated engagement with the edge surface of panel 12*c* in the identical manner.

FIG. 4 shows a preferred method of assembling the wall 10. With the panels 12*a*, 12*b* positioned so that the edge surface 36 of panel 12*a* is positioned in abutting juxtaposition with the edge surface 38 of the adjacent panel 12*b*, screws 74 are driven through the edge portions of the side members 32, 34. The screws 74 thus pass through the overlapping outer sides 48*a*, 48*b* and outward walls 68*a*, 68*b* of each projection 44*a*, 44*b* and channel 58*a*, 58*b* securing the panels 12*a*, 12*b* together. It is to be appreciated that when adjacent panels are secured in the manner shown in FIG. 4, the screws 74 align along opposing edge portions of panels 12*a*, 12*b*. As a result, any rotational stresses on the wall 10 is less likely to result in the delamination of the side panel members 32, 34 from the core 30.

It is to be appreciated, that the symmetrical construction of the panels 12*a–c* about the mid-plane $P–P_1$ facilitates panel manufacture and assembly.

In the preferred embodiments of the invention shown, each panel 12*a–c* is provided with open top and bottom edges at which the thermally insulating core 30 is exposed. If desired, the top and bottom edges of the panels could equally be provided with a metal or plastic cover or other such capping member to seal the insulating core 30 within the panel 12.

While the preferred embodiment of the invention discloses the assembly of the panels 12*a–c* into a structural wall 10, the invention is not so limited. Any number of the panels 12*a–c* could be secured together in a like manner to form a building roof, foundation, floor or other building structures. Similarly, while the preferred embodiment of the invention discloses the panels 12*a–c* as having a generally rectangular construction, it is to be appreciated that the invention is not so limited. For example, the panels 12*a–c* could have angled ends when joining at a roof gable or the like. Further, depending upon the panel usage, the panels could be provided with a wedge or polygonal shape in which abutting edge portions of adjacent panels are coupled together in essentially the identical manner to that shown in FIG. 4.

In the simplified construction shown, the outer side panel member 34 of each panel 12 is exposed. The structural wall 10 could be provided with a number of different exterior treatments which cover the panels 12. Covering treatments could include, for example, paint, siding, stucco, or brick for any desired finished appearance.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A prefabricated building panel comprising, first and second generally planar side members each having first and second longitudinally extending parallel edges, said first side member being spaced from and co-planar with said second side member, a first edge surface spanning between said first edge of said first and second side members substantially along their longitudinal length, said first edge surface including a pair of longitudinally extending spaced apart projecting members and a pair of shoulder members, said projecting members, each being symmetrically disposed about a mid-plane of the building panel and defining a longitudinally extending slot therebetween, a first one of said shoulder members joining said first side member and a first one of said projecting members, the second other one of said shoulder members joining said second side member and the second other one of said projecting members, a second edge surface spanning between said second edges of said first and second members substantially along their longitudinal length, said second edge surface configured for mated engagement with a first edge member of an adjacent panel and including, first and second spaced apart channels, each having a complementary size and shape to said first and second projection members, respectively, a tongue separating said first channel from said second channel and being centered on said panel mid-plane, said tongue sized for complementary fitted placement to completely fill in said slot and extending substantially the longitudinal length of the second edge member, a first end face extending from said first side member to said first channel, said first end face having a complementary size to said first shoulder member, a second end face extending from said second side member to said second channel, said second end face having a complementary size to said second shoulder member, a rigid insulating core material interposed between said first and second side members, wherein when said second edge surface is positioned in mated engagement with a first edge surface of an adjacent panel, said first and second projection members located in said respective first and second channels with said tongue disposed in said slot and said first end face abutting said first shoulder and said second end face abutting said second shoulder.

2. The building panels as claimed in claim 1 wherein said slot is open to said insulating core.

3. The building panel as claimed in claim 1 wherein said first shoulder member extends substantially perpendicular to said first side member.

4. The building panel as claimed in claim 2 wherein said tongue further comprises a thermal-break separating said first channel and said second channel.

5. The building panel as claimed claim 4 wherein said thermal-break comprises a strip comprising a thermally non-conductive material selected from the group consisting of rubber or plastic.

6. The building panel as claimed in claim 4 wherein said first and second side members comprise sheets of metal.

7. The building panels as claimed in claim 6 wherein said pair of projecting members and said pair of shoulder members are each formed from a sheet metal.

8. The building panel as claimed in claim 7 wherein said first side member and said first shoulder member and first projecting member are integrally formed from a single sheet of bent metal.

9. The building panel as claimed in claim 8 wherein said first side member, said first face member and said first channel are integrally formed from a single sheet of bent metal.

10. The building panel as claimed in claim 9 wherein each of said pair of projecting members and said pair of shoulder members are formed having a double wall construction.

11. A prefabricated building panel comprising, first and second generally planar metal side members, each of said first and second side members being elongated in a longitudinal direction and having first and second opposing substantially parallel edges, said first side member being spaced from and co-planar with said second side member, a first edge surface spanning substantially from said first edge of said first side member to said first edge of said second side member, and being substantially symmetrical about a mid-plane of said panel, said first edge surface including an associated first shoulder and first projecting member integrally formed with said first side member, and an associated second shoulder and second projecting member integrally formed with said second side member, said first shoulder joining said first projecting member and said first edge of said first side member, said second shoulder joining said second projecting member and said first edge of said second side member, said first and second projecting members being spaced from each other and defining a longitudinally extending channel-way therebetween centered along said panel mid-plane, a second edge surface spanning substantially from said second edge of said first side member to said second edge of the second side member, and being substantially symmetrical about said mid-plane, said second edge surface configured for abutting placement with the first end of a further adjacent building panel, said second end including, an associated first channel and first end face integrally formed with said first side member, an associated second channel and second end face integrally formed with said second side member, said first channel being spaced from said second channel by a thermal-break, and each of said first and second channels having a complementary size and shape to said respective first and second projecting members, said first end face extending from said first side member to said associated first channel, and said second end face extending from said second side member to said associated second channel, said thermal-break sized for insertion in and complete filling of said channel-way when said first projecting member locates in said first channel and said second projecting member locates in said second channel, rigid insulating core material being disposed intermediate said first and second side members, said insulating core extending into said first and second projecting members of said first edge surface and to said first and second end faces at said second edge surface of said panel.

12. A prefabricated building panel, comprising:

a first side member formed from a first sheet of construction material;

a second side member formed from a second sheet of construction material;

a thermally insulating core between said first and second side members;

a first edge defined by said first and second side members and said thermally insulating core having a channel-way providing a thermal break between said first and second side members at said first edge; and a second edge defined by said first and second side members and said thermally insulating core having a plug providing a thermal break between said first and second side members at said second edge, said first and second edges being complimentary so that said plug is received in and fills completely said channel-way when said prefabricated building panel is connected to a second prefabricated building panel.

13. The prefabricated building panel of claim 12, wherein said first and second sheets of construction material are doubled over along said first and second edges to provide a double-walled construction added rigidity.

14. The prefabricated building panel of claim 13, wherein said first and second sheets of construction material are metal.

15. The prefabricated building panel of claim 12, wherein said first edge defines a tongue and said second edge defines a groove, said tongue and groove being complimentary.

16. A prefabricated building panel, comprising:

a first side panel member;

a second side panel member;

a thermally insulating core disposed between said first and second side panel members;

a first panel end surface including a pair of spaced projections defining a channel-way; and a second panel end surface including a pair of spaced channels and a thermal barrier plug;

whereby when two of said prefabricated building panels are interconnected said pair of spaced projections on said first panel end surface of a first of said prefabricated building panels are received in said pair of spaced channels on said second panel end surface of a second of said prefabricated building panels and said thermal barrier plug on said second panel end surface of said second of said prefabricated building panels is received in and fills completely said channel-way on said first panel end surface of said first of said prefabricated building panels.

17. The prefabricated panel of claim 16, wherein said channel-way is positioned between said pair of spaced projections on said first panel end surface and said thermal barrier plug is positioned between said pair of spaced channels on said second panel end surface.

18. The prefabricated building panel of claim 16, wherein said first and second side panel members extend at least partially over said first and second panel end surfaces with said channel-way and said thermal barrier plug separating said first and second side panel members at said first and second panel end surfaces.

* * * * *